US011284703B2

(12) United States Patent
Wang et al.

(10) Patent No.: US 11,284,703 B2
(45) Date of Patent: Mar. 29, 2022

(54) AUTOMATIC SUCTION CLEANING STRUCTURE AND CLEANER

(71) Applicant: Zhejiang Beauty and Health Electrical Applicance Co., Ltd., Wenzhou (CN)

(72) Inventors: Rentong Wang, Wenzhou (CN); Zhiyong Yu, Wenzhou (CN)

(73) Assignee: Zhejiang Beauty and Health Electrical Appliance Co., Ltd., Zhejiang (CN)

( * ) Notice: Subject to any disclaimer, the term of this patent is extended or adjusted under 35 U.S.C. 154(b) by 508 days.

(21) Appl. No.: 16/276,421

(22) Filed: Feb. 14, 2019

(65) Prior Publication Data

US 2019/0174907 A1 Jun. 13, 2019

Related U.S. Application Data

(63) Continuation of application No. PCT/CN2017/089158, filed on Jun. 20, 2017.

(30) Foreign Application Priority Data

Aug. 16, 2016 (CN) ..... 201610671829.3

(51) Int. Cl.
*A47K 7/04* (2006.01)
*A46B 9/02* (2006.01)
(Continued)

(52) U.S. Cl.
CPC ..... *A46B 9/028* (2013.01); *A46B 7/04* (2013.01); *A46B 9/005* (2013.01); *A46B 13/008* (2013.01);
(Continued)

(58) Field of Classification Search
CPC ..... A47K 7/043; A46D 1/0238; A46B 13/02
See application file for complete search history.

(56) References Cited

U.S. PATENT DOCUMENTS 2,123,558 A * 7/1938 Althcide ..... A45D 24/26 132/114
7,410,683 B2 8/2008 Curro et al.
(Continued)

FOREIGN PATENT DOCUMENTS

CN 1835825 9/2006
CN 202134515 2/2012
(Continued)

OTHER PUBLICATIONS

"International Preliminary Report on Patentability dated Dec. 19, 2018; International Application No. PCT/CN2017/089158", Dec. 19, 2018.
(Continued)

*Primary Examiner* — Michael D Jennings
(74) *Attorney, Agent, or Firm* — Womble Bond Dickinson (US) LLP

(57) ABSTRACT

An automatic suction cleaning structure is disclosed. The automatic suction cleaning structure is disposed on a cleaner body. The automatic suction cleaning structure comprises a fixing base (1) connected to the cleaner body and a number of brush heads (2) arranged on the fixing base (1). The brush heads (2) are made of silica gel, and are of a hexagon shape and a hollow structure. The number of brush heads (2) are arranged on the fixing base (1) in an array and distributed in a cellular arrangement. By arranging the cellular brush heads (2) of a hollow structure and utilizing a suction force produced by the tightly-attached brush heads (2) during use, dirt on the skin surface is sucked automatically by means of
(Continued)

a sucking disc principle in a process of contact with the skin, to allow more thorough cleaning. A cleaner is also provided.

14 Claims, 3 Drawing Sheets

(51) Int. Cl.

| | |
|---|---|
| ***A46B 7/04*** | (2006.01) |
| ***A46B 9/00*** | (2006.01) |
| ***A46B 13/00*** | (2006.01) |
| ***A46D 1/00*** | (2006.01) |
| ***A46B 15/00*** | (2006.01) |

(52) U.S. Cl.
CPC ..... *A46B 15/0012* (2013.01); *A46D 1/0238* (2013.01); *A46D 1/0246* (2013.01); *A47K 7/04* (2013.01); *A46B 2200/102* (2013.01); *A46B 2200/104* (2013.01); *A46B 2200/1006* (2013.01)

(56) References Cited

U.S. PATENT DOCUMENTS

| | | | | |
|---|---|---|---|---|
| 2007/0186365 | A1* | 8/2007 | Armaly ..... | A46B 5/0095 15/244.1 |
| 2015/0141884 | A1* | 5/2015 | Thiebaut ..... | A61H 7/005 601/112 |

FOREIGN PATENT DOCUMENTS

| | | |
|---|---|---|
| CN | 103653716 | 3/2014 |
| CN | 106108747 | 11/2016 |
| CN | 206120194 | 4/2017 |
| WO | WO-2005/018879 | 3/2005 |

OTHER PUBLICATIONS

"International Search Report dated Feb. 22, 2018; International Application No. PCT/CN2017/089158", Feb. 22, 2018.

* cited by examiner

AUTOMATIC SUCTION CLEANING STRUCTURE AND CLEANER

CROSS REFERENCE TO RELATED APPLICATIONS

This application is a continuation of International Application No. PCT/CN2017/089158 filed on Jun. 20, 2017, which claims the benefit of Chinese Application No. 201610671829.3 filed on Aug. 16, 2016, the disclosures of which are incorporated herein by reference.

TECHNICAL FIELD

Embodiments of the disclosure relate to the field of skin and hair care, and particularly relate to an automatic suction cleaning structure and a cleaner.

BACKGROUND

Face cleansing devices, face washing brushes, and face cleaners have been widely incorporated into people's daily routines. Such devices, having either brush hair or silica gel, mainly achieve the function of cleaning the skin through vibration of the device, which cause the brush hair or silica gel heads to also vibrate.

Technical Problem

The existing technical problem is that the brush hair or silica gel head in the prior art do not have built-in suction capabilities.

BRIEF DESCRIPTION OF THE DRAWINGS

Description of the Drawings

Figure 1:
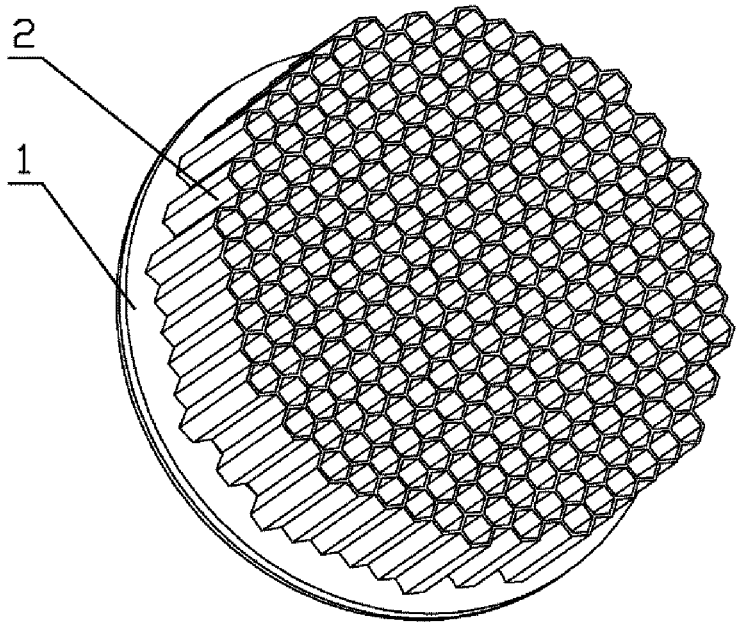

FIG. 1 is a schematic diagram of a structure according to one embodiment.

Figure 2:
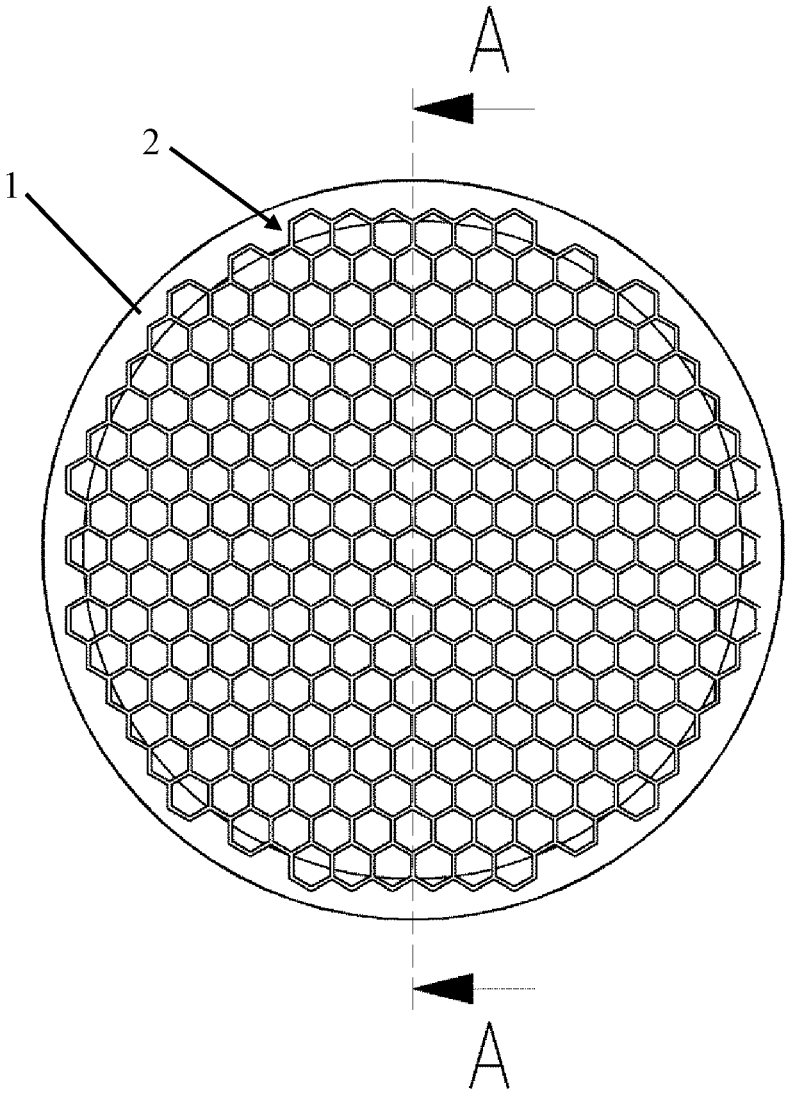

FIG. 2 is a schematic diagram of a plane view according to one embodiment.

Figure 3:
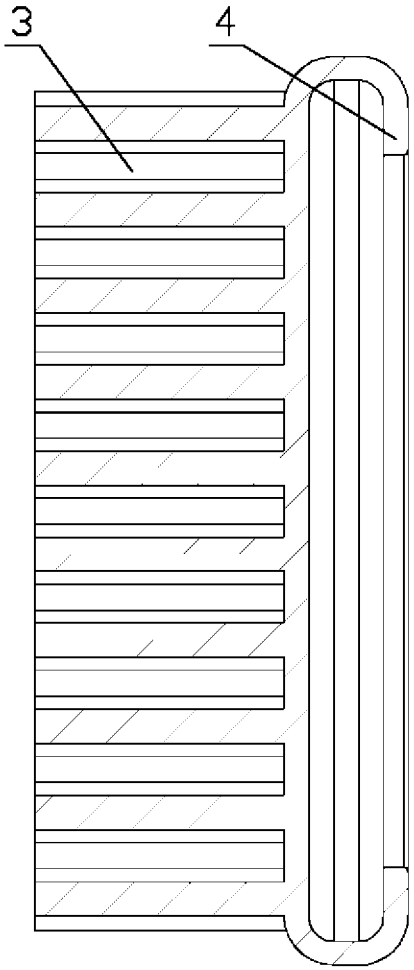

FIG. 3 is an A-A sectional view of FIG. 2.

DETAILED DESCRIPTION

Technical Solution

In order to overcome the drawbacks and disadvantages found in the background art, an automatic suction cleaning structure and a cleaner are proposed.

In some embodiments, an automatic suction cleaning structure comprises a fixing base connected to a cleaner body and a number of brush heads arranged on the fixing base, wherein the brush heads are made of a soft rubber material and have a hollow structure, and the number of brush heads are circumferentially arranged on the fixing base in an array and any one of the brush heads has an effect of suction when being squeezed.

In some embodiments, a cleaner having the foregoing automatic suction cleaning structure comprises a cleaner body on which the automatic suction cleaning structure is disposed.

Beneficial Effects

In some embodiments, cellular brush heads of a hollow structure are arranged and a suction force produced by the tightly-attached brush heads is utilized during use to automatically suck dirt on the skin surface by means of a sucking disc principle in a process of contact with the skin, thus allowing cleaning to be more thorough.

Embodiments of the Disclosure

Embodiments of the disclosure are further illustrated below with reference to the accompanying figures.

As shown in FIG. 1, FIG. 2, and FIG. 3, an automatic suction cleaning structure is provided. The structure comprises a fixing base 1 connected to a cleaner body and a number of brush heads 2 arranged on the fixing base, where the brush heads are made of silica gel, and the fixing base is made of silica gel. The fixing base is integrally formed with the brush heads. The brush heads are of a hexagon shape and have a hollow structure, and the number of brush heads is arranged on the fixing base in an array in a cellular distribution. Any one of the brush heads has an effect of suction upon squeezing or pressure.

Each brush head has an independent hollow structure, i.e., the brush head extends all the way from a top opening to the position of the fixing base, i.e., forming a U-shaped flute structure 3 as a whole. Furthermore, the brush heads adopts a regular hexagon structure, i.e., when the array is disposed on the fixing base, each surface of a brush head is in contact with another brush head, so that the number of brush heads are in a cellular distribution. By means of the shape of the cellular distribution and the hollow structures, a sucking disc effect can be produced in use, and dirt on the skin surface are sucked automatically when the array is in direct contact with the skin, allowing more thorough cleaning.

The fixing base is flexibly connected to the cleaner body, i.e., is replaceable, making detachment and cleaning convenient. Dirt in the brush heads can thus be removed to ensure cleanness of the brush heads.

The bottom of the fixing base circumferentially wraps inwardly to form a wrapping portion 4 which directly wraps on a vibration head of the cleaner body, and directly transmits vibrations to the brush heads, to make cleaning thereof more thorough.

In one embodiment, a cleaner having the above automatic suction cleaning structure is provided. The cleaner comprises a cleaner body on which the automatic suction cleaning structure is disposed.

The embodiments shall not be deemed as a limitation to the disclosure; rather, any improvements made based on the spirit of the disclosure shall fall within the protection scope of the disclosure.

What is claimed is:

1. An automatic suction cleaning structure, comprising:

a fixing base connected to a cleaner body; and a plurality of brush heads arranged on the fixing base;

wherein the brush heads are of a soft rubber material and each brush head has a hollow structure, wherein the brush heads are circumferentially arranged on the fixing base in an array and any one of the brush heads has an effect of suction when being squeezed;

wherein the fixing base is flexibly connected to the cleaner body;

wherein the bottom of the fixing base circumferentially wraps inwardly to form a wrapping portion.

2. The automatic suction cleaning structure according to claim 1, wherein the fixing base is made of silica gel.

3. The automatic suction cleaning structure according to claim 2, wherein the fixing base is integrally formed with the brush heads.

4. The automatic suction cleaning structure according to claim 1, wherein the brush heads extend from a top opening to a position of the fixing base.

5. The automatic suction cleaning structure according to claim 4, wherein the fixing base is integrally formed with the brush heads.

6. The automatic suction cleaning structure according to claim 1, wherein the brush heads are of a regular hexagon shape and distributed on the fixing base in a cellular arrangement.

7. The automatic suction cleaning structure according to claim 1, wherein the brush heads are made of silica gel.

8. The automatic suction cleaning structure according to claim 1, wherein the fixing base is integrally formed with the brush heads.

9. A cleaner having an automatic suction cleaning structure and a cleaner body on which the automatic suction cleaning structure is disposed, the automatic suction cleaning structure comprising:

a fixing base connected to the cleaner body; and a plurality of brush heads arranged on the fixing base;

wherein the brush heads are of a soft rubber material and each brush head has a hollow structure, wherein the brush heads are circumferentially arranged on the fixing base in an array and any one of the brush heads has an effect of suction when being squeezed;

wherein the fixing base is flexibly connected to the cleaner body;

wherein the bottom of the fixing base circumferentially wraps inwardly to form a wrapping portion.

10. The cleaner according to claim 9, wherein the fixing base is made of silica gel.

11. The cleaner according to claim 9, wherein the brush heads extend from a top opening to a position of the fixing base.

12. The cleaner according to claim 9, wherein the brush heads are of a regular hexagon shape and distributed on the fixing base in a cellular arrangement.

13. The cleaner according to claim 9, wherein the soft rubber material are made of silica gel.

14. The cleaner according to claim 9, wherein the fixing base is integrally formed with the brush heads.

* * * * *